US007109866B2

(12) United States Patent
Maitin et al.

(10) Patent No.: US 7,109,866 B2
(45) Date of Patent: Sep. 19, 2006

(54) ELECTRONIC ARTICLE SURVEILLANCE MARKER DEACTIVATOR USING AN EXPANDED DETECTION ZONE

(75) Inventors: Steven Maitin, Lake Worth, FL (US); Douglas Allen Drew, Boca Raton, FL (US); Reuel A. Ely, Plantation, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 140 days.

(21) Appl. No.: 10/764,007

(22) Filed: Jan. 23, 2004

(65) Prior Publication Data

US 2005/0162275 A1 Jul. 28, 2005

(51) Int. Cl.
*G08B 13/14* (2006.01)

(52) U.S. Cl. ..... 340/572.3; 340/505; 340/691.4

(58) Field of Classification Search ..... 340/572.1, 340/572.3, 572.4, 505, 10.1, 10.5, 10.51, 340/691.1, 691.4, 692, 815.45; 235/375; 705/16, 18

See application file for complete search history.

(56) References Cited

U.S. PATENT DOCUMENTS

| | | | | |
|---|---|---|---|---|
| 3,938,044 | A | 2/1976 | Lichtblau | |
| 4,565,996 | A * | 1/1986 | Close | 340/572.1 |
| 5,341,125 | A * | 8/1994 | Plonsky et al. | 340/572.3 |
| 5,917,412 | A * | 6/1999 | Martin | 340/572.3 |
| 6,400,273 | B1 * | 6/2002 | Bettine | 340/572.4 |
| 2003/0001007 | A1 * | 1/2003 | Lee et al. | 235/383 |

OTHER PUBLICATIONS

Sensormatic AMB-2010 Deactivator, Electronic Article Surveillance, Tyco Fire & Security, 2003.

* cited by examiner

*Primary Examiner*—Thomas Mullen
(74) *Attorney, Agent, or Firm*—Kacvinsky LLC

(57) ABSTRACT

A method and apparatus to deactivate an EAS security tag using an expanded detection zone are described.

19 Claims, 4 Drawing Sheets

ELECTRONIC ARTICLE SURVEILLANCE MARKER DEACTIVATOR USING AN EXPANDED DETECTION ZONE

BACKGROUND

An Electronic Article Surveillance (EAS) system is designed to prevent unauthorized removal of an item from a controlled area. A typical EAS system may comprise a monitoring system and one or more security tags. The monitoring system may create an interrogation zone at an access point for the controlled area. A security tag may be fastened to an item, such as an article of clothing. If the tagged item enters the interrogation zone, an alarm may be triggered indicating unauthorized removal of the tagged item from the controlled area.

When a customer presents an article for payment at a checkout counter, a checkout clerk either removes the security tag from the article, or deactivates the security tag using a deactivation device. In the latter case, improvements in the deactivation device may facilitate the deactivation operation, thereby increasing convenience to both the customer and clerk. Consequently, there may be need for improvements in deactivating techniques in an EAS system.

BRIEF DESCRIPTION OF THE DRAWINGS

The subject matter regarded as the embodiments is particularly pointed out and distinctly claimed in the concluding portion of the specification. The embodiments, however, both as to organization and method of operation, together with objects, features, and advantages thereof, may best be understood by reference to the following detailed description when read with the accompanying drawings in which:

DETAILED DESCRIPTION

The embodiments may be directed to an EAS system in general. More particularly, the embodiments may be directed to a deactivation system for an EAS system. In one embodiment, for example, the deactivation system may use an expanded detection zone to increase the detection range for a deactivator. The deactivation system may provide audible sounds and/or visual indicators to represent when a security tag is within the expanded detection zone, and further, whether the security tag is in an active state or inactive state. As a result, the deactivation system may realize increased performance leading to increased user satisfaction.

Numerous specific details may be set forth herein to provide a thorough understanding of the embodiments of the invention. It will be understood by those skilled in the art, however, that the embodiments of the invention may be practiced without these specific details. In other instances, well-known methods, procedures, components and circuits have not been described in detail so as not to obscure the embodiments of the invention. It can be appreciated that the specific structural and functional details disclosed herein may be representative and do not necessarily limit the scope of the invention.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Figure 1:
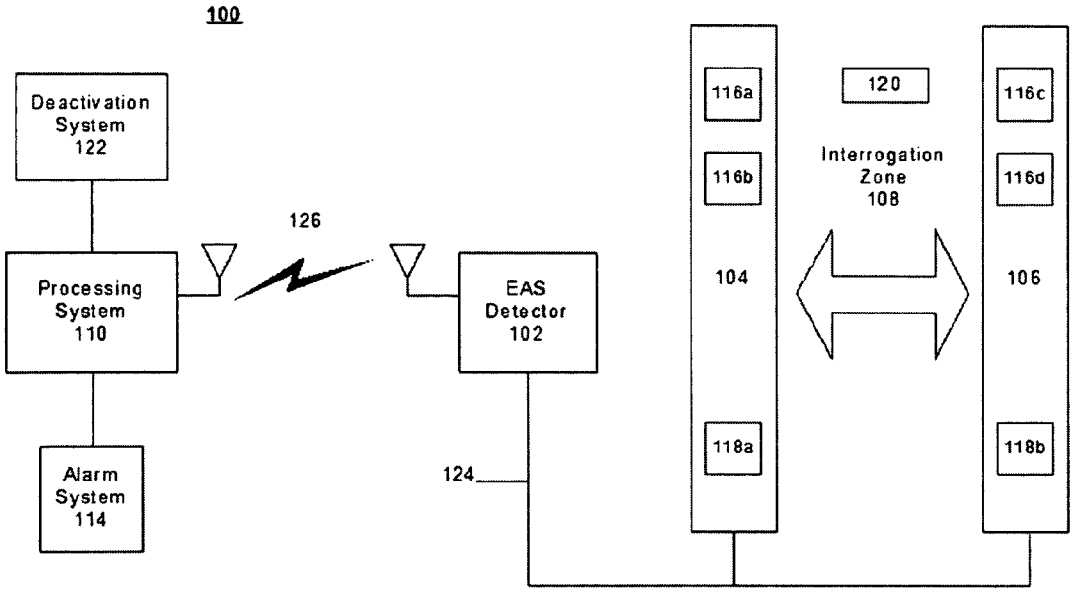
FIG. 1 illustrates a block diagram of an EAS system suitable for practicing one embodiment.

Referring now in detail to the drawings wherein like parts are designated by like reference numerals throughout, there is illustrated in FIG. 1 a system suitable for practicing one embodiment. FIG. 1 illustrates an EAS system 100. Although FIG. 1 describes a particular EAS system by way of example, it may be appreciated that the embodiments may operate with any EAS system as modified using the principles discussed herein.

In one embodiment, EAS system 100 may comprise EAS detection equipment, including an EAS marker detector 102 connected to a pedestal system via a communications medium 124. The pedestal system may comprise a pair of antenna pedestals, such as antenna pedestals 104 and 106, for example. The EAS detection equipment may be installed at an exit point of a controlled area, such as a retail store, for example.

In one embodiment, the EAS detection equipment may be used to create an interrogation zone 108 between antenna pedestals 104 and 106, for example. The interrogation zone may comprise an area receiving interrogation signals from EAS marker detector 102 via antennas 116*a–d* and 118*a–b* embedded within antenna pedestals 104 and 106. The interrogation signals may trigger a response from a security tag, such as an EAS security tag 120. The anti-theft functionality of EAS system 100 may be implemented through the interrogation and response interaction between EAS marker detector 102 and security tag 120.

In one embodiment, security tag 120 may comprise an EAS marker encased within a hard or soft outer shell. The marker may be any marker that emits a detectable signal when in interrogation zone 108. The marker may comprise, for example, a RF marker, a Radio-Frequency Identification (RFID) marker, an acoustically resonant magnetic EAS marker, a magnetic EAS marker, and so forth. An example of security tag 120 may comprise a Sensormatic® Ultra-Strip® EAS label made by Sensormatic Corporation. The embodiments are not limited with respect to the type of marker used for security tag 120 as long as it emits a detectable signal at the proper frequencies.

In one embodiment, security tag 120 may be designed to attach to an item to be monitored. Examples of tagged items may include an article of clothing, a Digital Video Disc (DVD) or Compact Disc (CD) jewel case, a movie rental container, packaging material, and so forth. The embodiments are not limited in this context.

In general operation, security tag 120 may enter interrogation zone 108 and receive one or more interrogation signals from EAS marker detector 102. Security tag 120 may receive the interrogation signals, and radiate a signal in response to the interrogation signals. The signal may be received by EAS marker detector 102. EAS marker detector 102 may determine whether to trigger an alarm based on the received signal.

In one embodiment, EAS system 100 may comprise EAS marker detector 102. EAS marker detector 102 may be configured to create an interrogation zone 108 between antenna pedestals 104 and 106 via the embedded antennas.

EAS marker detector 102 may also be configured to detect the presence of security tag 120 within interrogation zone 108. Once security tag 120 is within interrogation zone 108, EAS marker detector 102 may determine whether to send an alarm signal to an alarm system, such as alarm system 114.

In one embodiment, EAS marker detector 102 may also operate as a data reader and writer for an RFID chip. EAS marker detector 102 may interrogate and read a RFID chip included in security tag 120, if any. EAS marker detector 102 may also write data into the RFID chip. This may be accomplished using any wireless communication link between EAS marker detector 102 and security tag 120, for example.

In one embodiment, EAS system 100 may comprise a processing system 110. Processing system 110 may comprise any device having a general purpose or dedicated processor, machine-readable memory and computer program segments stored in the memory to be executed by the processor. An example of a processing system may include a computer, server, personal digital assistant, switch, router, laptop, cell phone and so forth. Processing system 110 may be used to store and execute application programs, such as an alarm control system, inventory control system, and so forth. The inventor control system, for example, may track information such as merchandise identification, inventory, pricing, and other data. Processing system 110 may also be configured with the appropriate hardware and/or software to function as an RFID reader, similar to EAS marker detector 102. This may be useful for implementing inventory tracking functionality and anti-theft functionality of EAS system 100, as desired for a given implementation.

In one embodiment, processing system 110 may be in communication with EAS marker detector 102 via a communication link 124. In one embodiment, communication link 124 may comprise a communication link over a wireless communication medium. The wireless communication medium may comprise one or more frequencies from the RF spectrum, for example. Communication link 124 may also represent a communication link over a wired communications medium as well. The wired communications medium may comprise twisted-pair wire, co-axial cable, Ethernet cables, and so forth. The embodiments for the communication link are not limited in this context.

In one embodiment, EAS system 100 may comprise an alarm system 114. Alarm system 114 may comprise any type of alarm system to provide an alarm in response to an alarm signal. The alarm signal may be received from any number of EAS components, such as processing system 110, EAS marker detector 102, deactivation system 122, and so forth. Alarm system 114 may comprise a user interface to program conditions or rules for triggering an alarm. Examples of the alarm may comprise an audible alarm such as a siren or bell, a visual alarm such as flashing lights, or a silent alarm. A silent alarm may comprise, for example, an inaudible alarm such as a message to a monitoring system for a security company. The message may be sent via a computer network, a telephone network, a paging network, and so forth. The embodiments are not limited in this context.

In one embodiment, EAS system 100 may comprise a deactivation system 122. Deactivation system 122 may be used to detect and deactivate a security tag, such as security tag 120. The term "deactivate" as used herein may refer to changing states for an EAS marker from an active state to an inactive state. While in the active state, the EAS marker may be configured to provide a response to the interrogation signals indicating the unauthorized presence of security tag 120 within interrogation zone 108. While in the inactive state, the EAS marker may be configured to provide no response to the interrogation signals, or provide a response to the interrogation signals indicating the authorized presence of security tag 120 within interrogation zone 108.

Although FIG. 1 illustrates deactivation system 122 as connected to processing system 110, it may be appreciated that deactivation system 122 may be a separate or standalone system as well. The embodiments are not limited in this context. Deactivation system 122 may be discussed in more detail with reference to FIGS. 2–4.

Figure 2:
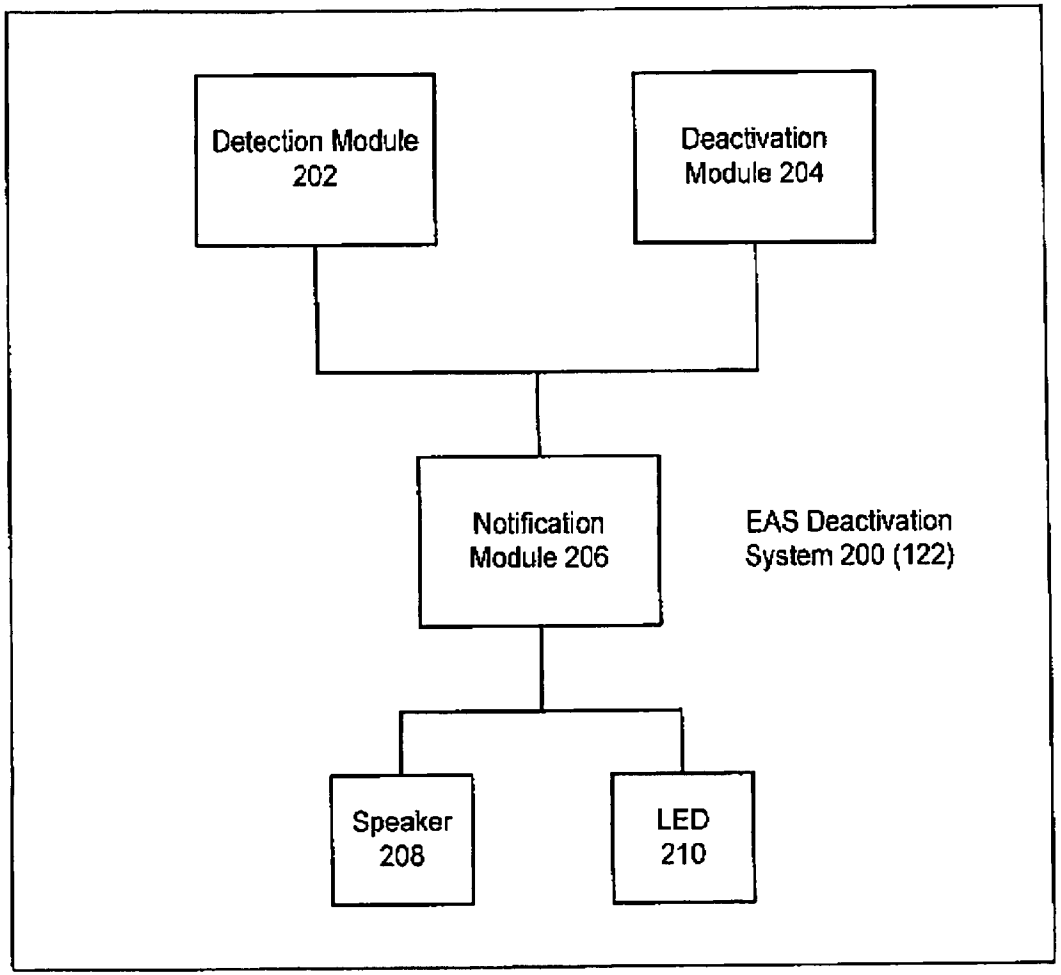
FIG. 2 illustrates a block diagram of an deactivation system in accordance with one embodiment.

FIG. 2 may illustrate a deactivation system in accordance with one embodiment. FIG. 2 may illustrate an EAS deactivation system 200. In one embodiment, deactivation system 200 may be representative of, for example, deactivation system 122. Deactivation system 200 may comprise a detection module 202, a deactivation module 204, a notification module 206, a speaker 208 and one or more Light Emitting Diodes (LED) 210. Although the embodiment has been described in terms of "modules" to facilitate description, one or more circuits, components, registers, processors, software subroutines, or any combination thereof could be substituted for one, several, or all of the modules.

In one embodiment, deactivation system 200 may comprise a detection module 202. Detection module 202 may be configured to detect a security tag having an EAS marker. Detection module 202 may be any appropriate detection module configured to detect a given EAS marker. Detection module 202 may comprise transmit/receive coils and associated processing circuitry to create a detection zone to detect the presence of an EAS marker for an EAS security tag, such as EAS security tag 120. Once detection module 202 detects the presence of an EAS marker, it may send a signal to a deactivation module 204 to initiate the deactivation operation to deactivate the EAS marker, thereby rendering it undetectable by the EAS detection equipment when passing through the interrogation zone.

In one embodiment, deactivation system 200 may comprise a deactivation module 204. Deactivation module 204 may be configured to deactivate an EAS marker. Deactivation module 204 may be any appropriate deactivation module configured to deactivate a given EAS marker. For example, deactivation module 204 may create a deactivation zone to deactivate the EAS marker. Deactivation module 204 may create the deactivation zone using a coil circuit to generate a magnetic field having an amplitude profile sufficient to deactivate a "magneto-mechanical" EAS marker. The term "amplitude profile" may refer to the peak amplitudes of a waveform over a given time interval. Magneto-mechanical EAS markers may include an active element and a bias element. When the bias element is magnetized in a certain manner, the resulting bias magnetic field applied to the active element causes the active element to be mechanically resonant at a predetermined frequency upon exposure to an interrogation signal which alternates at the predetermined frequency. The EAS detection equipment used with this type of EAS marker generates the interrogation signal and then detects the resonance of the EAS marker induced by the interrogation signal. To deactivate the magneto-mechanical EAS markers, the bias element may be degaussed by exposing the bias element to an alternating magnetic field that has an initial magnitude that is greater than the coercivity of the bias element, and then decays to zero over a time interval. After the bias element is degaussed, the EAS marker's resonant frequency is substantially shifted from the predetermined interrogation signal frequency, and the EAS marker's response to the interrogation signal is at too low an amplitude for detection by the detecting apparatus. At this point the EAS marker may be placed in an inactive state, thereby rendering it undetectable by the detecting apparatus.

Detection module 202 and deactivation module 204 may work together to form a detection zone and deactivation zone, respectively, for deactivation system 200. In many cases, the detection zone may have a greater range than the deactivation zone. For example, deactivation module 204 may generate a deactivation zone within three inches of the coils used to create the deactivation zone. In this case, a user may need to bring the EAS marker within three inches of the surface of deactivation system 200. Detection module 202, however, may generate a detection zone that is greater than three inches, such as five or six inches, for example. Detection system 200 uses the greater range of the detection zone in conjunction with the deactivation zone to implement additional functionality for deactivation system 200. The detection and deactivation zones may be described in more detail with reference to FIG. 3.

Figure 3:
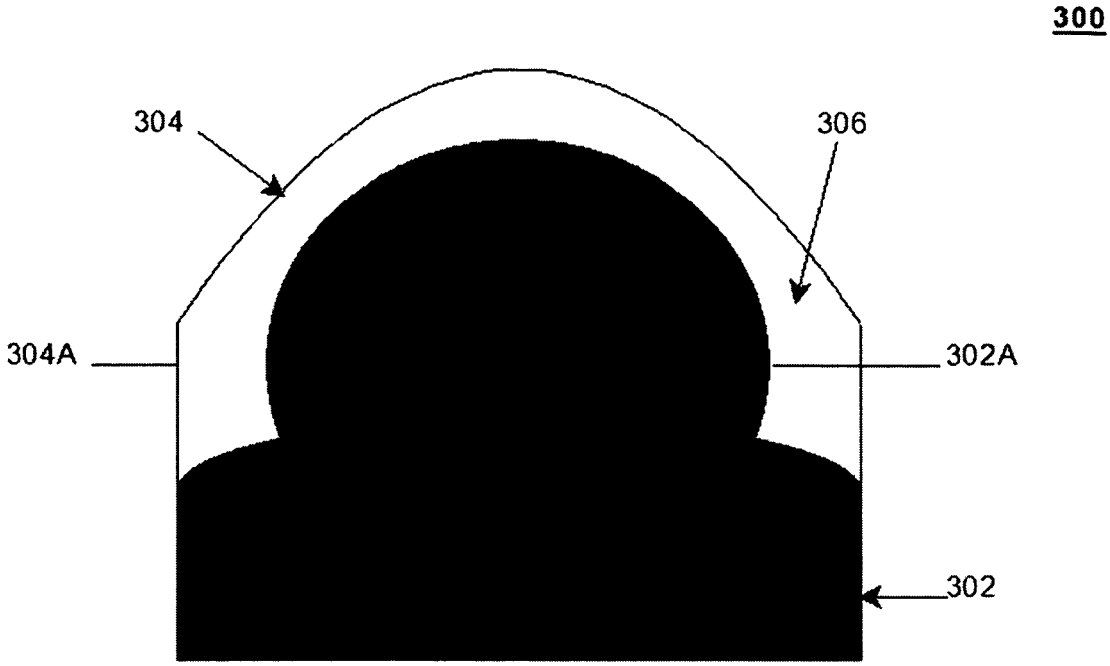
FIG. 3 illustrates a detection zone and deactivation zone in accordance with one embodiment.

FIG. 3 illustrates a detection zone and a deactivation zone in accordance with one embodiment. FIG. 3 illustrates two-dimensional representation of a detection zone and deactivation zone produced by a deactivation system, such as deactivation system 200, for example. Although FIG. 3 illustrates a two-dimensional representation of the detection zone and deactivation zone, it may be appreciated that the actual detection zone and deactivation zone may have three dimensions when actually implemented.

Deactivation system 200 may create a deactivation zone 302 having a deactivation zone perimeter 302A. Deactivation system 200 may also create a detection zone 304 having a detection zone perimeter 304A. In one embodiment, detection zone 304 may have a greater range than deactivation zone 302. As shown in FIG. 3, deactivation zone perimeter 302A of deactivation zone 302 may fit within detection zone perimeter 304A of detection zone 304. Since deactivation zone perimeter 302A is less than detection zone perimeter 304A, overlapping deactivation zone 302 and detection zone 304 may form an expanded zone 306 between deactivation zone perimeter 302A and detection zone perimeter 304A.

Expanded zone 306 may provide a number of advantages for deactivation system 200. For example, deactivation system 200 may use expanded zone 306 to make a user aware that an EAS security tag was detected but not within the specified deactivation zone. In another example, the deactivation system may alert the user that they have properly deactivated the EAS security tag. In yet another example, the deactivation system may alert the user that the marker was detected, but not properly deactivated. The embodiments are not limited in this context.

Upon detecting an EAS marker within the expanded zone, detection module 202 may send a notification signal to notification module 206 to indicate the presence of the EAS marker within the detection zone. In addition, detection module 202 may determine whether the EAS marker is in an active state or an inactive state, and may send an appropriate notification signal to notification module 206 in accordance with the determination.

In one embodiment, notification module 206 may receive the notification signals from detection module 202. Notification module 206 may process the notification signals and generate one or more audio signals to represent audio information for reproduction by speaker 208. Notification module 206 may also generate one or more visual signals to represent visual indicators for reproduction by LED 210. By using different audio and visual signals, a user may be given instant feedback on the current state of security tag 120. For example, a first set of audio and/or visual signals may represent the presence of an active EAS marker within expanded zone 306. In another example, a second set of audio and/or visual signals may represent the presence of an inactive EAS marker within expanded zone 306. In yet another example, a third set of audio and/or visual signals may represent an active EAS marker exiting expanded zone 306. The number and type of audio and visual signals are not limited in this context.

The operations of systems 100 and 200 may be further described with reference to FIG. 4 and accompanying examples. Although FIG. 4 as presented herein may include a particular programming logic, it can be appreciated that the programming logic merely provides an example of how the general functionality described herein can be implemented. Further, the given programming logic does not necessarily have to be executed in the order presented unless otherwise indicated. In addition, although the given programming logic may be described herein as being implemented in the above-referenced modules, it can be appreciated that the programming logic may be implemented anywhere within the system and still fall within the scope of the embodiments.

Figure 4:
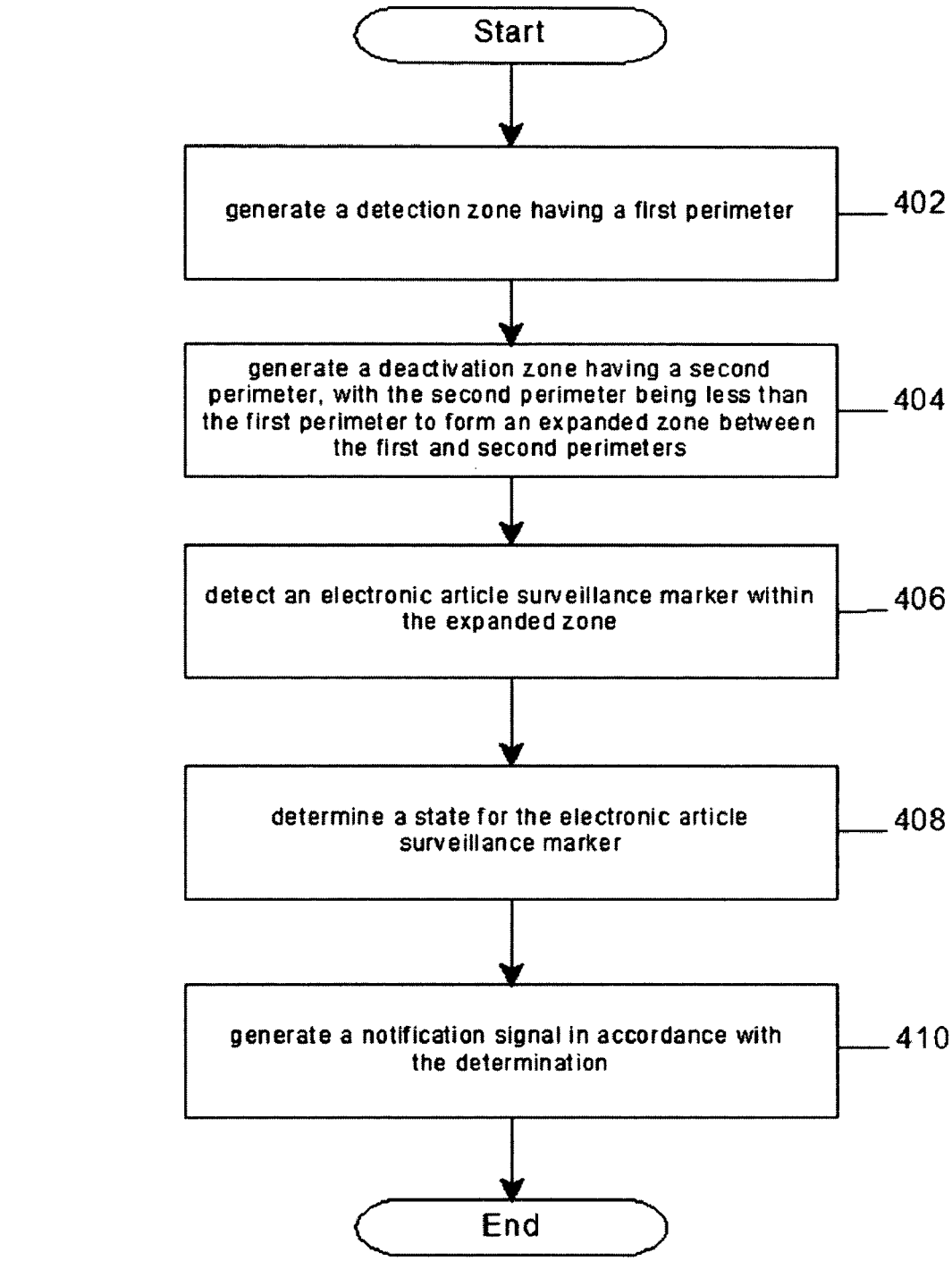
FIG. 4 illustrates a programming logic for a deactivation system in accordance with one embodiment.

FIG. 4 illustrates a programming logic for a deactivation system in accordance with one embodiment. FIG. 4 illustrates a programming logic 400. Programming logic 400 may be executed by, for example, deactivation system 200. As shown in programming logic 400, a detection zone having a first perimeter may be generated at block 402. A deactivation zone having a second perimeter may be generated at block 404. The range of the second perimeter may be less than the first perimeter to form an expanded zone between the first and second perimeters. An EAS marker may be detected within the expanded zone at block 406. A state may be determined for the EAS marker at block 408. At block 410, a notification signal may be generated in accordance with the determination made at block 408.

In one embodiment, for example, the EAS marker may have an active state. In this case, a first notification signal may be generated to indicate that the EAS marker is within the expanded zone in an active state. This may be useful, for example, to inform a user that there is a security tag near deactivation system 200, but not close enough to be deactivated. The user may be quickly informed of this information through the use of a unique set of audible sounds and/or visual indicators. Consequently, the first notification signal may comprise a first audio signal and a first visual signal to provide this unique set of indicators.

In one embodiment, for example, the EAS marker may have an inactive state. In this case, a second notification may be generated to indicate that the EAS marker is within the expanded zone in an inactive state. This may be useful, for example, to inform a user that the security tag has already been deactivated without having to bring the EAS marker within the more restrictive range of the deactivation zone. The user may be informed of this information using another unique set of audible sounds and/or visual indicators. Consequently, the second notification signal may comprise a second audio signal and a second visual signal to provide this unique set of indicators.

In one embodiment, for example, a user may be informed that an active EAS marker has entered the expanded zone, and is exiting the expanded zone without having been deactivated. In this case, a third notification signal may be generated to indicate that the EAS marker is exiting the expanded zone in an active state. Again, a unique set of audio sounds and/or visual indicators may be used to convey this information to a user.

In one embodiment, for example, a user may be informed that an active EAS marker has entered the deactivation zone and has been properly deactivated. In this case, a user may bring the EAS marker within the deactivation zone. Once the EAS marker is within the deactivation zone for a predetermined amount of time, the magnetic field of the deactivation zone may deactivate the EAS marker by changing the EAS marker from an active state to an inactive state. The predetermined amount of time may vary in accordance with the type of deactivation zone created by the deactivation module. A fourth notification signal may be generated to indicate that the EAS marker has been properly deactivated. The fourth notification signal may be used to reproduce a unique set of audio sounds and/or visual indicators to convey this information to a user.

It may be appreciated that terms such as "first notification signal", "second notification signal, "third notification signal," "fourth notification signal", and related terminology, are used to distinguish between different types of notification signals, and do not necessarily refer to a specific temporal sequence of signals.

The operation of systems 100 and 200, and the programming logic shown in FIG. 4, may be better understood by way of example. Assume deactivation system 200 may be implemented as part of an EAS system for a retail store selling DVDs. The retail store may tag the jewel case of each DVD with security tag 120 having an EAS marker. The jewel case for each DVD may be sourced tagged or retail tagged. An example of deactivator system 200 may comprise the AMB-2010 Deactivator made by Sensormatic Corporation, although the embodiments are not limited in this context. Further assume that deactivation system 200 is implemented at a Point Of Sale (POS) terminal in the form of a table top implementation or flush mounted with the surface of the sales counter. Deactivation system 200 may provide a deactivation zone having a deactivation height of three inches or 7.6 centimeters (cm).

When a customer presents an item to a sales clerk, the sales clerk may deactivate security tag 120 attached to the item using deactivation system 200. When the security tag is brought within range of detection zone 304, detection module 202 may send an interrogation signal to the active element of the EAS marker within security tag 120 and then detects the resonance of the EAS marker induced by the interrogation signal. Deactivation system 200 may provide a unique set of audible and visual indicators to quickly represent different events to the sales clerk based on the resonance signal from the EAS marker.

Assume that the receive response to the interrogation signal indicates an EAS marker in an active state. Detection module 202 may send a notification signal to notification module 206 that an active EAS marker has been detected within detection zone 304 in general, and expanded zone 306 in particular. Notification module 206 may generate a unique tone to represent this event via an audio signal sent to speaker 208. The unique tone may comprise, for example, a 100 millisecond (msec) pulsed tone that is continuous as long as the active EAS marker remains in expanded zone 306. Simultaneously, notification module 206 may generate a visual indicator signal for a first LED 210 labeled "Detect" on the surface of deactivation system 200. The Detect LED 210 may light up with a specific color to indicate an active EAS marker in expanded zone 306. For example, Detect LED 210 may display the color red to notify the user of this event.

Assume that the receive response to the interrogation signal indicates an EAS marker in an active state, thereby making Detect LED 210 display to turn red and speaker 208 to reproduce the 100 msec pulse tone. Further assume that the sales clerk does not lower security tag 120 within the three inch deactivation zone, and moves security tag 120 out of detection zone 304 and expanded zone 306. Detection module 202 may detect the entry and exit of the active EAS marker, and sends a notification signal to notification module 206. Notification module 206 may generate a unique tone to represent this event via an audio signal sent to speaker 208. The unique tone may comprise, for example, a 100 millisecond (msec) pulsed tone that continues for two seconds after the EAS marker has passed outside of detection zone 304. Simultaneously, notification module 206 may generate a visual indicator signal for Detect LED 210 by having it flash red at a predetermined rate to notify the user of this event.

Assume that the receive response to the interrogation signal indicates an EAS marker in an inactive state. Detection module 202 may send a notification signal to notification module 206 that an inactive EAS marker has been detected within detection zone 304 in general, and expanded zone 306 in particular. Notification module 206 may generate a visual indicator signal to display the color amber via Detect LED 210. The amber color may notify the user that security tag 120 has been properly deactivated. An optional audible signal may also be provided via speaker 208 if desired for a given implementation.

Assume that the sales clerk lowers security tag 120 to within deactivation zone 302. Upon detecting the active EAS marker, detection module 202 may send a signal to deactivation module 204 to generate deactivation zone 302. Alternatively, deactivation module 204 may continuously generate deactivation zone 302 thereby obviating the need for the signal from detection module 202. In any event, deactivation module 204 may generate deactivation zone 302. When the sales clerk brings the active EAS marker within deactivation zone 302, deactivation zone 302 may degauss the bias element of the EAS marker by exposing the bias element to an alternating magnetic field that has an initial magnitude that is greater than the coercivity of the bias element, and then decays to zero over a time interval. After the bias element is degaussed, the EAS marker's resonant frequency is substantially shifted from the predetermined interrogation signal frequency, and the EAS marker's response to the interrogation signal is at too low an amplitude for detection by the detecting apparatus. At this point the EAS marker may be changed from an active state to an inactive state, thereby rendering it undetectable by the detecting apparatus. Once the EAS marker has been changed to an inactive state, detection module 202 may send a notification signal to notification module 206. Notification module 206 may provide an audible tone via speaker 208, such as a single one second tone or beep. Notification module 206 may also provide a visual indicator via a LED 210 labeled "Deactivation." The Deactivation LED 210 may flash or hold an amber color to indicate to the sales clerk that security tag 120 has been properly deactivated.

As a default mode, assume that an EAS marker is not within range of detection zone 304. In this mode, detection module 202 may send a notification signal to notification module 206 to light up or display a color such as green on a LED 210 labeled "Ready." The Ready LED 210 may indicate to the sales clerk that deactivation system 200 is ready for use and is currently detecting no EAS markers within detection zone 304.

The embodiments may be implemented using an architecture that may vary in accordance with any number of factors, such as desired computational rate, power levels, heat tolerances, processing cycle budget, input data rates, output data rates, memory resources, data bus speeds and other performance constraints. For example, one embodiment may be implemented using software executed by a processor. The processor may be a general-purpose or dedicated processor, such as a processor made by Intel® Corporation, for example. The software may comprise computer program code segments, programming logic, instructions or data. The software may be stored on a medium accessible by a machine, computer or other processing system. Examples of acceptable mediums may include computer-readable mediums such as read-only memory (ROM), random-access memory (RAM), Programmable ROM (PROM), Erasable PROM (EPROM), magnetic disk, optical disk, and so forth. In one embodiment, the medium may store programming instructions in a compressed and/or encrypted format, as well as instructions that may have to be compiled or installed by an installer before being executed by the processor. In another example, one embodiment may be implemented as dedicated hardware, such as an Application Specific Integrated Circuit (ASIC), Programmable Logic Device (PLD) or Digital Signal Processor (DSP) and accompanying hardware structures. In yet another example, one embodiment may be implemented by any combination of programmed general-purpose computer components and custom hardware components. The embodiments are not limited in this context.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

The invention claimed is:

1. A method, comprising:

generating a detection zone having a first perimeter;

generating a deactivation zone having a second perimeter, with said second perimeter being substantially within said first perimeter to form an expanded zone between said first and second perimeters;

detecting an electronic article surveillance marker within said expanded zone;

determining a state for said electronic article surveillance marker; and generating a notification signal in accordance with said determination.

2. The method of claim 1, wherein said state is an active state, and said generating comprises generating a first notification signal to indicate that said electronic article surveillance marker is within said expanded zone in an active state.

3. The method of claim 2, wherein said first notification signal comprises a first audio signal and a first visual signal.

4. The method of claim 1, wherein said state is an inactive state, and said generating comprises generating a second notification signal to indicate that said electronic article surveillance marker is within said expanded zone in an inactive state.

5. The method of claim 4, wherein said second notification signal comprises a second audio signal and a second visual signal.

6. The method of claim 1, wherein said state is an active state, and further comprising:

detecting that said electronic article surveillance marker is exiting said expanded zone in said active state; and generating a third notification signal to indicate that said electronic article surveillance marker is exiting said expanded zone in said active state.

7. The method of claim 1, wherein said state is an active state, and further comprising:

receiving said electronic article surveillance marker in said active state within said deactivation zone;

deactivating said electronic article surveillance marker by changing said active state to an inactive state; and generating a fourth notification signal to indicate that said electronic article surveillance marker has been deactivated.

8. An apparatus, comprising:

a detection module to generate a detection zone having a first perimeter;

a deactivation module to generate a deactivation zone having a second perimeter, with said second perimeter being substantially within said first perimeter to form an expanded zone between said first and second perimeters;

a notification module to connect to said detection module and said deactivation module, said notification module to provide audible and visual notification in accordance with a notification signal generated by one of said detection module and deactivation module; and wherein said detection module is configured to detect an electronic article surveillance marker within said expanded zone, determine a state for said electronic article surveillance marker, and generate a notification signal in accordance with said state for said electronic article surveillance marker.

9. The apparatus of claim 8, further comprising:

a speaker to connect to said notification module; and a light emitting diode to connect to said notification module.

10. The apparatus of claim 9, wherein said detection module determines that said electronic article surveillance marker is in an active state, and generates a first notification signal to indicate that said electronic article surveillance marker is within said expanded zone in an active state.

11. The apparatus of claim 10, wherein said notification module receives said first notification signal, and sends a first audio signal to said speaker to produce a first audible sound, and sends a first visual signal to said light emitting diode to produce a first visual indicator.

12. The apparatus of claim 9, wherein said detection module determines that said electronic article surveillance marker is in an inactive state, and generates a second notification signal to indicate that said electronic article surveillance marker is within said expanded zone in an inactive state.

13. The apparatus of claim 12, wherein said notification module receives said second notification signal, and sends a second audio signal to said speaker to produce a second audible sound, and sends a second visual signal to said light emitting diode to produce a second visual indicator.

14. The apparatus of claim 9, wherein said detection module determines that said electronic article surveillance marker is in an active state and is exiting said expanded zone, said detection module to generate a third notification signal to indicate that said electronic article surveillance marker is exiting said expanded zone in said active state.

15. The apparatus of claim 14, wherein said notification module receives said third notification signal, and sends a third audio signal to said speaker to produce a third audible sound, and sends a third visual signal to said light emitting diode to produce a third visual indicator.

16. The apparatus of claim 9, wherein said deactivation module deactivates said electronic article surveillance marker by changing said active state to an inactive state when said electronic article surveillance marker enters said deactivation zone, said deactivation module to generate a fourth notification signal to indicate that said electronic article surveillance marker has been deactivated.

17. The apparatus of claim 16, wherein said notification module receives said fourth notification signal, and sends a fourth audio signal to said speaker to produce a fourth audible sound, and sends a fourth visual signal to said light emitting diode to produce a fourth visual indicator.

18. The apparatus of claim 9, further comprising:

a set of antennas to form an interrogation zone;

a marker detector to connect to said set of antennas, said marker detector to detect an electronic article surveillance marker when in said interrogation zone;

a processing system to receive and process signals from said marker detector; and an alarm system to connect to said processing system, said alarm system to produce an alarm in response to said processed signals.

19. The apparatus of claim 9, further comprising said electronic article surveillance marker, said electronic article surveillance marker to produce an active signal in response to an interrogation signal when in an active state, and an inactive signal in response to said interrogation signal when in an inactive state.

* * * * *